US008579739B2

(12) United States Patent
Song

(10) Patent No.: US 8,579,739 B2
(45) Date of Patent: Nov. 12, 2013

(54) ARROW SHAFT HAVING FRONT/REAR TWO-STAGE SPINE STRUCTURE

(76) Inventor: In Gyu Song, Busan (KR)

( * ) Notice: Subject to any disclaimer, the term of this patent is extended or adjusted under 35 U.S.C. 154(b) by 0 days.

(21) Appl. No.: 13/527,829

(22) Filed: Jun. 20, 2012

(65) Prior Publication Data

US 2013/0267360 A1 Oct. 10, 2013

(30) Foreign Application Priority Data

Apr. 6, 2012 (KR) ..... 10-2012-0035914

(51) Int. Cl.
*F42B 6/04* (2006.01)

(52) U.S. Cl.
USPC ..... 473/578

(58) Field of Classification Search
USPC ..... 473/578
See application file for complete search history.

(56) References Cited

U.S. PATENT DOCUMENTS

| | | | | |
|---|---|---|---|---|
| 6,179,736 | B1 * | 1/2001 | Thurber | 473/578 |
| 6,251,036 | B1 * | 6/2001 | Wu et al. | 473/578 |
| 6,554,726 | B2 | 4/2003 | Thurber | |
| 2003/0073524 | A1 * | 4/2003 | Song | 473/578 |

FOREIGN PATENT DOCUMENTS

| | | | |
|---|---|---|---|
| KR | 2002-0057554 | A | 7/2002 |
| KR | 10-0396590 | B1 | 9/2003 |
| KR | 10-0655934 | B1 | 12/2006 |
| KR | 10-0655951 | B1 | 12/2006 |
| KR | 10-1063366 | B1 | 9/2011 |

* cited by examiner

*Primary Examiner* — John Ricci

(74) *Attorney, Agent, or Firm* — Birch, Stewart, Kolasch & Birch, LLP

(57) ABSTRACT

Provided is an arrow shaft having a front and rear two stage spine structure and including a front end to which an arrowhead is coupled and a rear end to which a nock is coupled, wherein the arrow shaft has a hollow tubular shape and is divided and defined into a front part and a rear part in a longitudinal direction thereof such that spine strengths of the arrow shaft are different between the front part including a center of gravity of the arrow shaft and the rear part to which the nock is coupled; wherein the front and rear parts of the arrow shaft are formed by an arrow shaft shaping sheet constituted of three layers; wherein an uppermost layer of the arrow shaft shaping sheet includes a front sheet and a rear sheet respectively formed of a carbon fabric sheet each having different elastic strengths.

6 Claims, 3 Drawing Sheets

ARROW SHAFT HAVING FRONT/REAR TWO-STAGE SPINE STRUCTURE

BACKGROUND OF THE INVENTION

1. Field of the Invention

The present invention relates, in general, to an arrow shaft, and more particularly to an arrow shaft having a structure divided into two parts each having different spine strengths in a longitudinal direction of the arrow shaft, so that a deformation or fracture of the center of gravity of the arrow shaft due to an archer's paradox phenomenon necessarily occurring during flight of an arrow can be inhibited, a splitting of the arrow shaft due to impact applied to the arrow shaft upon shooting can be prevented, shooting accuracy of the arrow shaft can be increased, and partial deformation or fracturing of the arrow shaft due to frequent shooting can be prevented.

2. Description of the Related Art

FIG. 1 is a schematic view showing a conventional arrow shaft according to the related art.

In general, arrows include an arrow shaft 11 having a hollow cylinder shape, an arrowhead 12 on a front end of the arrow shaft 11, a nock 13 at a rear end of the arrow shaft 11, and feathers 14 attached on a rear outer peripheral surface of the arrow shaft.

An arrow that has left the string of a bow is typically subject to a thrust which is the force by which the string pushes a rear end of the arrow. Such a thrust is transferred towards a front portion of the arrow to allow the arrow to fly.

Such an arrow undergoes an archer's paradox phenomenon when the arrow leaves and flies from the string toward a target. The archer's paradox means a phenomenon whereby an arrow flies while mainly bending from side to side in an initial flight phase immediately after the arrow has left the string.

In shooting the arrow, because kinetic energy is momentarily transferred to the arrow as if the arrow were in a stopped state, while the string is released, the arrow cannot withstand such a force. As a result, the arrow bends about a pressure point and is again straightened back to the original state by a restorative force of the arrow shaft which is an elastic body, then being bent in the opposite direction due to inertia. The arrow flies while continuously repeating such a movement until the inertial energy is dissipated.

However, for an archery arrow, the arrow is shot a few ten or hundred times a day. Therefore, the effects of such an archer's paradox on the arrow shaft can be more severe than thought. Specifically, as shown in FIG. 2, the arrow shaft can be innumerably bent about a pressure point (i.e., the center of gravity; G) in a bow shape from one direction to the others during flight. When the arrow shaft continually undergoes such a phenomenon, a middle portion of the arrow shaft where the center of gravity G is located can be deformed or fractured.

In order to overcome such a problem, there has been proposed an arrow shaft in which a hollow aluminum tube is disposed as a core inside the arrow shaft, a carbon fiber sheet is laminated on an outer surface of the aluminum tube to form a double layer, and then front and rear potions of the carbon fiber sheet are ground by a grinder to make the arrow fatter in a middle portion of the arrow shaft.

However, because the diameter of the arrow shaft of such a product is adjusted by grinding the carbon fiber sheet layer, there are the problems of maintaining the dimensions thereof, a machining defect can be readily occurred in an inside texture of the sheet layer upon grinding, and an eccentric nature can be imposed on the arrow shaft due to failure of managing the dimensions precisely. In addition, bonding between the aluminum core and the carbon fiber sheet layer which are different materials can be difficult, and the weight of the arrow shaft can be increased because the aluminum tube is included therein. This is a critical problem.

Also, because outer peripheral surfaces of the front and rear portions of the arrow shaft must be grounded to impart it with the required diameter, the waste of material can be serious and the processing time it takes to do the machining can be extended, leading to a decrease in productivity.

In particular, the carbon fiber sheet layer can peel or come off the aluminum tube due to an impact on the arrow shaft, a difference in thermal expansion coefficient between such different materials, and the like.

As described above, the archer's paradox phenomenon occurs in the arrow, as soon as the arrow is shot from the bow. In this case, if the strength, weight and length of the arrow shaft are not suitable for the strength of the bow, the arrow cannot fly in a straight line.

In general, having a stronger spin means that a strength, i.e., a spine, of an arrow is stronger than the strength of the bow, whereas having a weaker spin means that the strength of an arrow is weaker than the strength of a bow.

For this reason, in order to determine the strength of an arrow shaft, a predetermined weight is hung on the center of the arrow shaft to measure the degree of bending of the arrow shaft, and thereby the arrow shaft suited to the strength of the bow is chosen. Such a degree of bending corresponds to the above spine.

As the spine of the arrow shaft is increased, advantages include improving the capability of the arrow to fly straight and a deformation of materials due to the frequent archer's paradox phenomenon can be reduced. However, because the spine of the arrow has to be determined in consideration of the strength of the bow, it is not always advantageous for the spine to be unconditionally increased. In addition, when increasing the spine of the arrow, material and manufacturing costs can be increased.

Meanwhile, the arrow shaft is subject to different external forces depending on locations along its longitudinal direction. Specifically, the middle portion of the arrow shaft is subjected to frequently repeated bending forces due to the archer's paradox phenomenon as described above, and is likely to be weakened thereby after being used for a long term, and the front portion of the arrow shaft to which an arrow head is coupled is subject to most of the impact of hitting a target when frequently shooting. In contrast, the rear portion of the arrow shaft to which a nock is coupled is subject to most of the impact applied by a string of a bow.

Thus, the elasticity, strength and other physical properties the arrow shaft must vary depending on locations in the longitudinal direction. Therefore, although materials having different physical properties were required to be used depending on each of the locations in fabricating the arrow shaft, conventional arrows have been fabricated of only a single sheet material and such needs have not satisfied.

Therefore, in Korean Patent No. 10-1063366 to the present applicant entitled "Arrow Shaft Having Front/Middle/Rear Three-Stage Spine Structure," the present applicant has proposed an arrow shaft which is configured by dividing and defining the arrow shaft into a front part to which an arrow head is coupled, a middle part corresponding to the center of gravity of the arrow shaft, and a rear part to which a nock is coupled, and then by laminating and winding arrow shaft shaping sheets each having different elastic strengths on each of the parts, such that spine strengths of the front, middle, and rear parts of the arrow shaft can be different from each other.

However, according to the above Korean Patent, a third sheet layer, which is an uppermost layer, is provided by bonding front, middle and rear sheets respectively formed of carbon fiber sheets each having elastic strengths which are different from each other and then by laminating and winding the resulted sheet. Therefore, there are problems that the operation is complex and the number of steps is increased, leading to decreasing the productivity.

DOCUMENTS OF RELATED ART

Korean Patent No. 10-1063366 entitled "Arrow Shaft Having Front/Middle/Rear Three-Stage Spine Structure";

Korean Patent Application Publication No. 10-2002-0057554 entitled "Arrow Shaft and Method for Manufacturing Thereof";

Korean Patent No. 0396590 entitled "Method for Manufacturing Arrow Shaft";

Korean Patent No. 0655934 entitled "Arrow Shaft"; and

Korean Patent No. 0655951 entitled "Arrow Shaft."

The description of the related art is merely intended to promote understanding of the background of the present invention. Accordingly, it should not be interpreted as admitting that such a description is the related art with which those having ordinary skill in the art are familiar.

SUMMARY OF THE INVENTION

Accordingly, the present invention has been made keeping in mind the above problems occurring in the related art, and an object of the present invention is to provide an arrow shaft which is configured by dividing the arrow shaft into two parts having a predetermined length ratio along its longitudinal direction in consideration of different physical properties of the arrow shaft being required depending on locations in the longitudinal direction, and then by laminating and winding carbon fabric sheets each having different physical properties on each of the parts, such that the durability of the arrow shaft can be increased, splitting of the arrow shaft can be prevented, and also flight performance such as flight stability and straight advancing property can be optimized.

In particular, another object of the present invention is to provide an arrow shaft which is configured by generally dividing and defining the arrow shaft into a front part and a rear part along its longitudinal direction in contrast to the related art and then by applying a front sheet and a rear sheet respectively formed of carbon fabric sheet each having different elastic strengths to each of the parts, such that strengths or spines between the front part and the rear part can be differentiated and be relative to each other, thereby optimizing material properties of the arrow shaft without incurring additional costs.

In addition, a further object of the present invention is to provide an arrow shaft which, compared to an arrow shaft having a front/middle/rear three stage spine structure according to the related art, has a smaller tendency to split and the strength of the arrow shaft can be superior, but the manufacturing process can be more simple, thereby achieving enhanced productivity.

In order to achieve the above objects, according to one aspect of the present invention, there is provided an arrow shaft having a front/rear two stage spine structure and including a front end to which an arrowhead is coupled and a rear end to which a nock is coupled, wherein the arrow shaft has a hollow tube shape and is divided and defined into a front part and a rear part along a longitudinal direction thereof such that the arrow shaft has different spine strengths between the front part including the center of gravity of the arrow shaft and the rear part to which the nock is coupled; wherein the arrow shaft is formed by winding an arrow shaft shaping sheet, the arrow shaft shaping sheet including: a first single sheet layer having a plurality of carbon fibers arranged in parallel in one direction and configured to cover both of the front and rear parts; a second single sheet layer attached and connected to a lower end of the first single sheet layer, the second single sheet layer having a plurality of carbon fibers arranged in parallel in another direction and configured to cover both of the front and rear parts; and a third sheet layer attached and connected to a lower end of the second single sheet layer, the third sheet layer including a front sheet formed of a carbon fabric sheet to cover the front part and a rear sheet formed of another carbon fabric sheet having higher elastic strength than that of the front sheet to cover the rear part, wherein the front sheet is connected to the rear sheet.

In this case, the front sheet and the rear sheet of the third sheet layer may be respectively formed of carbon fabric sheets each having woven carbon fibers which are arranged in different directions.

Also, a length ratio of the front part to the rear part may be in a range of 6:4~7:3 based on the total length of the arrow shaft.

In addition, a border cover film may be provided on a border portion between the front sheet and the rear sheet.

According to the present invention, the following effects may be obtained.

The arrow shaft is fabricated by differentiating strengths or spines required on the front part and the rear part depending on locations along the longitudinal direction of the arrow shaft and using sheets formed of materials which are suitable for their respective parts. Therefore, the durability, flight stability and straight advancing property of the arrow shaft can be enhanced.

According to the present invention, to improve the durability and the flight stability of the arrow shaft, the arrow shaft is fabricated by providing therein only the shaping sheet having differentiated properties and then by laminating and winding the shaping sheets on a mandrel without performing additional special treatment on the arrow shaft. Therefore, the arrow shaft with optimized strength and durability can be manufactured without incurring additional manufacturing cost.

The arrow shaft of the present invention is fabricated by using carbon fabric sheets each having different elastic strengths for both outermost layers in the front and rear parts of the arrow shaft. Thus, the tendency to split or break due to impacts applied on the arrow shaft is smaller, thereby providing excellent durability.

In particular, the arrow shaft is divided into the front part including a portion to which an arrowhead is coupled and the center of gravity, and the rear part including feathers and the nock of an arrow. Then, carbon fabric sheets suitable each of the parts are respectively laminated and wound on each of the parts. Therefore, physical properties of the arrow can be improved and simultaneously the manufacturing process can be simplified compared to an arrow shaft having a front/middle/rear three stage spine structure according to the related art.

In addition, when the spine strength of the rear part of the arrow shaft is stronger than that of the front part as in the present invention, a weight balance between the front part of the arrow shaft having the arrowhead coupled thereto, which is formed of a metal material and hence is relatively heavy, and the rear part of the arrow shaft having the nock coupled thereto, which is relatively light, can be maintained. Accordingly, the flight stability and straight advancing property of the arrow can be improved.

BRIEF DESCRIPTION OF THE DRAWINGS

The above and other objects, features and further advantages of the present invention will be more clearly understood from the following detailed description when taken in conjunction with the accompanying drawings, in which.

DETAILED DESCRIPTION OF THE INVENTION

Figure 1:
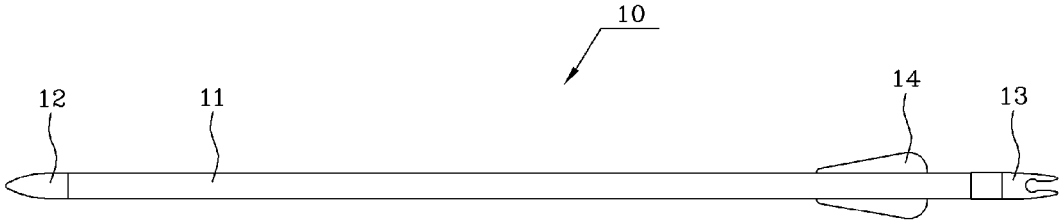
FIG. 1 is a schematic view showing a conventional arrow shaft according to the related art.
Figure 2:
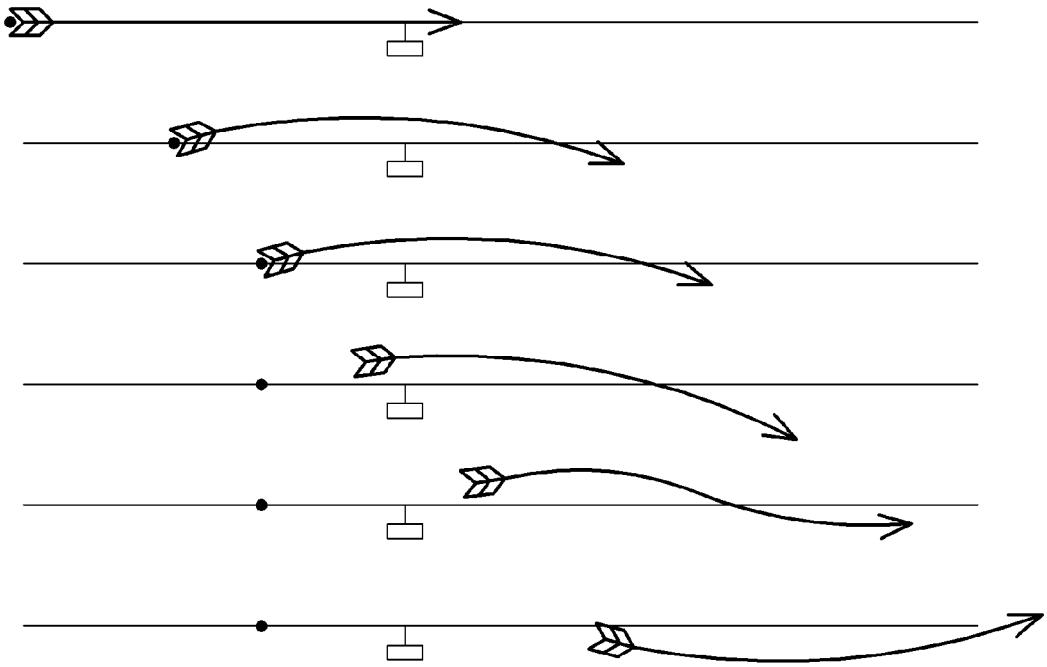
FIG. 2 is a conceptual diagram showing an archer's paradox.

The present invention relates to an arrow shaft which is fabricated by dividing the arrow shaft into two parts at a predetermined ratio in the longitudinal direction, and then by laminating and winding sheet layers suitable to each of the parts on a respective part, such that material performance and physical properties of the arrow shaft can be improved and thus the flight stability and straight advancing property of an arrow can be enhanced and the durability of the arrow shaft can be highly increased.

According to the present invention, a front end portion of the arrow shaft, which has an arrow head coupled thereto and is subject to most of the impact of hitting a target, and a middle portion of the arrow shaft, which is likely to be weakened by the repeated occurrence of the archer's paradox phenomenon during the flight of the arrow, are reinforced. In addition, the strength and elasticity of a rear end portion of the arrow shaft, which is repeatedly subject to impacts applied by a string of a bow, are enhanced. As a result, the arrow shaft having a smaller tendency to split upon impact and having stronger durability relative to deformations or fractures can be obtained.

Reference will now be made in greater detail to the construction and operating principle of the invention, an example of which is illustrated in the accompanying drawings. Wherever possible, the same reference numerals will be used throughout the drawings and the description to refer to the same or like parts.

Figure 3:
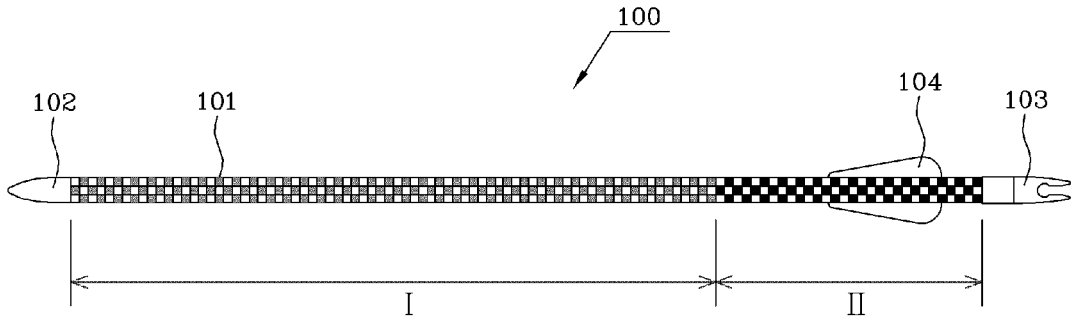
FIG. 3 is a schematic view showing an arrow shaft according to the present invention.

FIG. 3 shows a schematic view of an arrow according to the present invention. The arrow 100 of the invention includes an arrow shaft 101 having a hollow tube shape. The arrow shaft 101 is divided and defined into two parts from a front end having an arrowhead 102 coupled thereto to a rear end having a nock 103 coupled thereto. Namely, the arrow shaft 101 is divided into a front part I and a rear part II at a predetermined ratio from the front end to the rear end in the longitudinal direction. Reference numeral 104, which is indicated in the drawings but not described in detail herein, designates arrow feathers.

The distinguishing characteristics of the structure of the present invention will be compared to Korean Patent No. 10-1063366 entitled "Arrow Shaft Having Front/Middle/Rear Three-Stage Spine Structure", the disclosure of which is hereby incorporated by reference in its entirety. Namely, the above Korean Patent discloses an arrow shaft which is configured by dividing the arrow shaft into three parts including front, middle and rear parts along its longitudinal direction and then by winding shaping sheets each having different elastic strengths on each of the parts. However, the arrow shaft has the problem of a complex manufacturing process.

Specifically, when a third sheet layer, which is an uppermost layer, is constituted of front, middle and rear sheets as disclosed in the above Korean Patent, the front, middle and rear sheets each having different physical properties must be individually cut out and then border portions for each other and border portions between the sheets and a second layer are connected by an adhesive and the like to form a single sheet. Therefore, there are the problems of an increase in the number of steps and the operation being complex, leading to a decrease in productivity.

In addition, according to Korean Patent No. 10-1063366, among the front, middle and rear parts of the arrow shaft, the middle part has the highest spine strength. In fact, it is, however, found that the rear part of the arrow shaft is a portion to which an impact caused by a string of an arrow is most greatly applied, and thus the strength of the rear part must be higher than that of the front part.

Accordingly, to improve such problems, the present invention provides an arrow shaft which is generally divided into a front part including the center of gravity of the arrow shaft and a rear part as a portion to which a nock of an arrow is installed, and a carbon fabric sheet is applied on the rear part such the elastic strength of the rear part is higher than that of the front part. Namely, the front part of the arrow shaft is defined as a portion which extends over a predetermined length to cover the area from a front end having an arrowhead coupled thereto to the center of gravity of the arrow shaft, and the rear part is defined as a portion which extends form a terminating end of the front part to a rear end of the arrow shaft to which the nock is installed.

Figure 4:
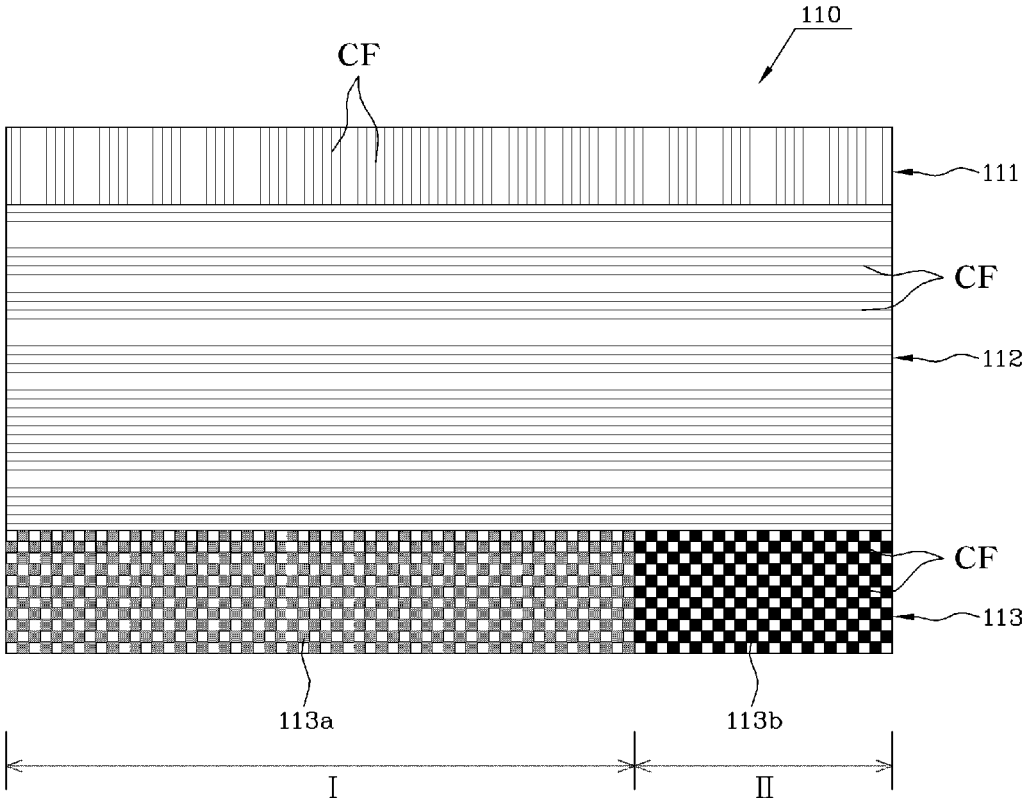
FIG. 4 is a developed view showing an arrow shaft shaping sheet according to a first embodiment of the present invention.

FIG. 4 shows a developed view of an arrow shaft shaping sheet according to a first embodiment of the present invention. An arrow shaft is formed by the arrow shaft shaping sheet 110 as shown and in this case, is manufactured in the following sequence of steps: cutting the arrow shaft shaping sheet→laminating and winding→taping→heat treating/cooling→extracting a mandrel→polishing.

The arrow shaft shaping sheet 110 is formed of an elastic sheet such as a carbon fiber sheet, or a carbon fabric sheet formed by weaving carbon fibers in two directions.

The arrow shaft shaping sheet 110 of the embodiment generally includes a first sheet layer 111 as a lowermost layer, a second sheet layer 112 as a middle layer, and a third sheet layer 113 as an uppermost layer.

The first sheet layer 111 has an array of a plurality of carbon fibers (CF) arranged in parallel in one direction (e.g., a longitudinal direction in FIG. 4), and the second sheet layer 112 has an array of a plurality of carbon fibers (CF) arranged in parallel in another direction (e.g., the transverse direction in FIG. 4).

The third sheet layer 113 is constituted of different materials depending on locations corresponding to the front part I and the rear part II of the arrow shaft. A front sheet 113*a* which is a portion of the shaping sheet 110 corresponding to the front part I and a rear sheet 113*b* which is a portion of the shaping sheet 110 corresponding to the rear part II are carbon fabric sheet layers formed by weaving carbon fibers in an intersecting manner.

The front part I and the rear part II of the arrow shaft according to the embodiment are formed by laminating the shaping sheet 110 on a rod-shaped metal mandrel and then undergoing the steps as described above. The sheets 111, 112, and 113 for each layer are formed by pre-pregging either a plurality of carbon fibers arranged in parallel in a predetermined direction or a carbon fiber fabric. Namely, the sheets are fabricated by impregnating the carbon fibers in a resin such as an epoxy resin, a polyester resin, or a thermoplastic resin.

Border portions among the first sheet layer 111, the second sheet layer 112, and the third sheet layer 113 are connected to each other by bonding, and also a border portion between the front sheet 113*a* and the rear sheet 113*b* of the third sheet layer 113 is connected to each other by bonding. Therefore, the arrow shaft shaping sheet 110 of the present invention is a single sheet in which the first sheet layer 111, the second sheet layer 112, and the third sheet layer 113 are connected to each other.

As a material for fabricating the arrow shaft 101, an elastic sheet such as a carbon fiber sheet is mainly used. The type of carbon fiber sheet used may vary depending on the use thereof, and hence the tensile strength, elastic modulus, elongation, weight and density may be different depending on the type or model thereof.

Tables 1 to 5 below show some examples of carbon fiber sheets produced by Hankuk Carbon Co., Ltd. of Korea classified by degree of elasticity and model number.

TABLE 1

General Elastic Prepreg (24 TON)

| Code Names | Carbon Fiber Weights (gr/cm$^2$) | Resin Weights (gr/cm$^2$) | Resin Contents (%) | Scrim Weight (gr/m$^2$) | Total Weights (gr/m$^2$) | Thickness (mm) |
|---|---|---|---|---|---|---|
| CU 0501 | 54 | 38 | 41 ± 2 | 34 | 126 | 0.092 |
| CU 0753 | 75 | 48 | 39 ± 2 | 34 | 157 | 0.112 |
| CU 1003 | 100 | 61 | 38 ± 2 | 34 | 195 | 0.136 |
| CU 1253 | 125 | 73 | 37 ± 2 | 34 | 232 | 0.160 |
| CU 1503 | 150 | 84 | 36 ± 2 | 34 | 268 | 0.183 |
| CU 1753 | 175 | 94 | 35 ± 2 | 34 | 303 | 0.206 |
| CU 2003 | 213 | 115 | 35 ± 2 | 34 | 362 | 0.244 |
| CU 2503 | 250 | 135 | 35 ± 2 | 34 | 419 | 0.281 |

TABLE 2

Middle Elastic Prepreg (30 TON)

| Code Names | Carbon Fiber Weights (gr/cm$^2$) | Resin Weights (gr/cm$^2$) | Resin Contents (%) | Scrim Weight (gr/m$^2$) | Total Weights (gr/m$^2$) | Thickness (mm) |
|---|---|---|---|---|---|---|
| MCU 0503 | 55 | 38 | 41 ± 2 | 34 | 127 | 0.092 |
| MCU 0753 | 75 | 46 | 38 ± 2 | 34 | 155 | 0.110 |
| MCU 1003 | 100 | 52 | 34 ± 2 | 34 | 186 | 0.129 |
| MCU 1253 | 125 | 64 | 34 ± 2 | 34 | 223 | 0.153 |
| MCU 1503 | 150 | 77 | 34 ± 2 | 34 | 261 | 0.178 |
| MCU 1753 | 175 | 90 | 34 ± 2 | 34 | 299 | 0.202 |
| MCU 2003 | 200 | 103 | 34 ± 2 | 34 | 337 | 0.227 |
| MCU 2503 | 250 | 129 | 34 ± 2 | 34 | 413 | 0.276 |

TABLE 3

High Elastic Prepreg (36 TON)

| Code Names | Carbon Fiber Weights (gr/cm$^2$) | Resin Weights (gr/cm$^2$) | Resin Contents (%) | Scrim Weight (gr/m$^2$) | Total Weights (gr/m$^2$) | Thickness (mm) |
|---|---|---|---|---|---|---|
| HCU 0503 | — | — | — | 34 | — | — |
| HCU 0753 | 75 | 48 | 39 ± 2 | 34 | 157 | 0.111 |
| HCU 1003 | 112 | 55 | 33 ± 2 | 34 | 201 | 0.138 |
| HCU 1253 | 139 | 68 | 33 ± 2 | 34 | 241 | 0.164 |
| HCU 1503 | 167 | 82 | 33 ± 2 | 34 | 283 | 0.191 |
| HCU 1753 | 195 | 96 | 33 ± 2 | 34 | 325 | 0.218 |
| HCU 2003 | 223 | 110 | 33 ± 2 | 34 | 367 | 0.246 |
| HCU 2503 | 278 | 137 | 33 ± 2 | 34 | 449 | 0.299 |

TABLE 4

High Elastic Prepreg (40 TON)

| Code Names | Carbon Fiber Weights (gr/cm$^2$) | Resin Weights (gr/cm$^2$) | Resin Contents (%) | Scrim Weight (gr/m$^2$) | Total Weights (gr/m$^2$) | Thickness (mm) |
|---|---|---|---|---|---|---|
| 40HCU 0503 | 55 | 40 | 42 ± 2 | 34 | 129 | 0.094 |
| 40HCU 0753 | 75 | 48 | 39 ± 2 | 34 | 157 | 0.112 |
| 40HCU 1003 | 112 | 55 | 33 ± 2 | 34 | 201 | 0.138 |
| 40HCU 1253 | 139 | 68 | 33 ± 2 | 34 | 241 | 0.164 |
| 40HCU 1503 | 167 | 82 | 33 ± 2 | 34 | 283 | 0.191 |
| 40HCU 1753 | 195 | 96 | 33 ± 2 | 34 | 325 | 0.218 |
| 40HCU 2003 | 223 | 110 | 33 ± 2 | 34 | 367 | 0.246 |
| 40HCU 2503 | 278 | 137 | 33 ± 2 | 34 | 449 | 0.299 |

TABLE 5

Carbon Fabric Prepreg

| Code Names | Fabric Weights (gr/cm$^2$) | Resin Weights (gr/cm$^2$) | Resin Contents (%) | Total Weights (gr/m$^2$) |
|---|---|---|---|---|
| CF-1114EPC | 91 | 66 | 42 ± 2 | 157 |
| CF-1115EPC | 117 | 85 | 42 ± 2 | 202 |
| CF-3327EPC | 205 | 148 | 42 ± 2 | 353 |
| CF-6638EPC | 331 | 194 | 42 ± 2 | 525 |
| CF-3118EPC | 119 | 86 | 42 ± 2 | 205 |
| CF-3115EPC | 111 | 80 | 42 ± 2 | 191 |
| 6K-FABRIC | 200 | 145 | 42 ± 2 | 345 |
| 3K-FABRIC | 185 | 134 | 42 ± 2 | 319 |

In the above Tables, ton numbers used for carbon fiber prepreg sheets mean the weight applied on an area of 1 square mm. For example, 24TON as a ton number for a carbon fiber sheet means 24TON/mm$^2$. Thus, as ton numbers of carbon fiber sheets are higher and higher, the carbon fiber sheets are high elastic sheets having higher strengths. Accordingly, in the description below, ton numbers, spins and elastic strengths of carbon fiber sheets will be defined and used in the same way.

There are various types of pre-pregged carbon fiber sheets (hereafter, shortly referred to as carbon fiber sheets) in the above Tables and they are produced in various models from a general elastic sheet to high elastic sheets having very high elasticity. Also, the carbon fiber sheets have different tensile strength, elastic modulus, tensile modulus, elongation, mass per unit length, and density depending on degrees of elasticity.

In general, assuming that thicknesses of the carbon fiber sheets are equal, it can be said that the elastic strength is excellent when the number of carbon fibers arranged in a unit area or the weight thereof is increased.

In addition, carbon fabric sheets, which are fabricated by weaving carbon fibers arranged in different directions in an intersecting manner, have the advantages of an excellent elastic strength and a smaller tendency to split compared to sheets which are constituted of only carbon fibers arranged in one predetermined direction. Therefore, according to the present invention, in the shaping sheet 110 constituted of three sheet layers, carbon fiber sheets which have an array of carbon fibers arranged in parallel in a predetermined direction are used for the first sheet layer 111 and the second sheet layer 112 which are underlying layers, and carbon fabric sheets which are woven by intersecting carbon fibers with each other are used for the third sheet layer 113 which is an outermost layer.

The first sheet layer 111 is a lowermost sheet layer which is attached and makes in direct contact with the mandrel, and is formed of a carbon fiber sheet having relatively lower elasticity and lower strength. The second sheet layer 112 is connected with the first sheet layer 111 such that an array of carbon fibers in the second sheet layer 112 is perpendicular to that of the first sheet layer 111. The third sheet layer 113 is divided into two parts along a longitudinal direction of the arrow shaft 101 and is formed of different carbon fabric sheets for each part.

For the front part I of the arrow shaft 101, a carbon fabric sheet having a higher elastic strength (ton number or spine) than that of the carbon fiber sheet for the second sheet layer 1112 is selected as the front sheet 113*a*, and for the rear part II, a carbon fabric sheet having a higher elastic strength or spine than that of the front sheet 113*a* is selected as the rear sheet 113*b*. Therefore, for the third sheet layer 113 which is the outermost layer, among the sheet layers wound around an outer periphery of the mandrel, the rear part II has a stronger spine than that of the front part I.

According to the embodiment, the length ratio between the front part I and the rear part II is preferably configured such that, when the total length of the arrow shaft 101 is 100%, the length of the front part I is 60~70% of the total length and the length of the rear part II is 30~40% of the total length. Namely, the length ratio of the front part I to the rear part II of the arrow shaft is preferably in a range of 6:4~7:3. Then, the front part I of the arrow shaft includes the front end of the arrow shaft to which the arrowhead 102 is coupled and the center of gravity which is a pressure point caused by the archer's paradox phenomenon, and the rear part II includes the rear end of the arrow shaft to which the nock 103 is coupled and hence impacts are frequently applied.

When the arrow shaft 101 is configured as described heretofore, the carbon fabric sheets are applied to the outermost layer such that the spine of a waist portion of the arrow shaft can be strengthened, thereby preventing breakage or deformation of the arrow shaft, such as splitting or fracture, due to the repeated impact and the archer's paradox phenomenon, and also preventing the front part I and the rear part II of the arrow shaft 101 from being broken or deformed due to frequent shooting of the arrow. In particular, when the spine strength of the rear part II of the arrow shaft is stronger than that of the front part I as in the present invention, the weight balance between the front part I of the arrow shaft having the arrowhead 102 coupled thereto, which is formed of a metal material and hence is relatively heavy, and the rear part II of the arrow shaft having the nock 103 coupled thereto, which is relatively light, can be maintained such that the flight stability and straight advancing property of the arrow can be improved.

A method for manufacturing an arrow shaft using the arrow shaft shaping sheet 110 as described above will now be described.

First, a release agent is applied on the entire outer peripheral surface of a mandrel (not shown) to easily release a mold, and then an adhesive is applied on the release agent. The arrow shaft shaping sheet 110, which is pre-pregged and suitably cut in a predetermined length, is wound and bonded to the outer peripheral surface of the mandrel. Specifically, the first sheet layer 111, which is an end portion of the arrow shaft shaping sheet 110, is bonded on the surface of the mandrel, and then the shaping sheet 110 is laminated and wound on the mandrel using a rolling machine (not shown). This is the rolling step.

After completing the rolling step, a film is wound on an outermost surface of the resulted mandrel/sheet laminate using a taping machine (not shown). This is the taping step. As the film, use of a PET film or OPP film is preferable. The taping step is performed before the product which has been through the rolling step has been shaped, in order to discharge air remaining between the sheet layers to the outside and increase the degree of lamination inside the product.

Next, the tapped mandrel/sheet laminate is shaped by step-by-step varying a temperature during a predetermined period of them, and then the mandrel is released. In this case, preferably, the shaping temperature is ranges between about 80~150□, and the heating time is on the order of about 1~4 hours.

Finally, both ends of the released arrow shaft body are cut such that the arrow shaft has a desired length, for example about 825 mm, and then the film is peeled and an outer peripheral surface of the arrow shaft body is polished by means of a centerless polishing step.

After completing the process as described above, the arrow shaft 101 according to the embodiment, which has spine strengths divided into two parts along the longitudinal direction of the arrow shaft 101, can be obtained.

The manufacturing process of the arrow shaft as described above can be applied in common to all of the following other embodiments, and accordingly the repeated description thereof will be omitted.

Figure 5:
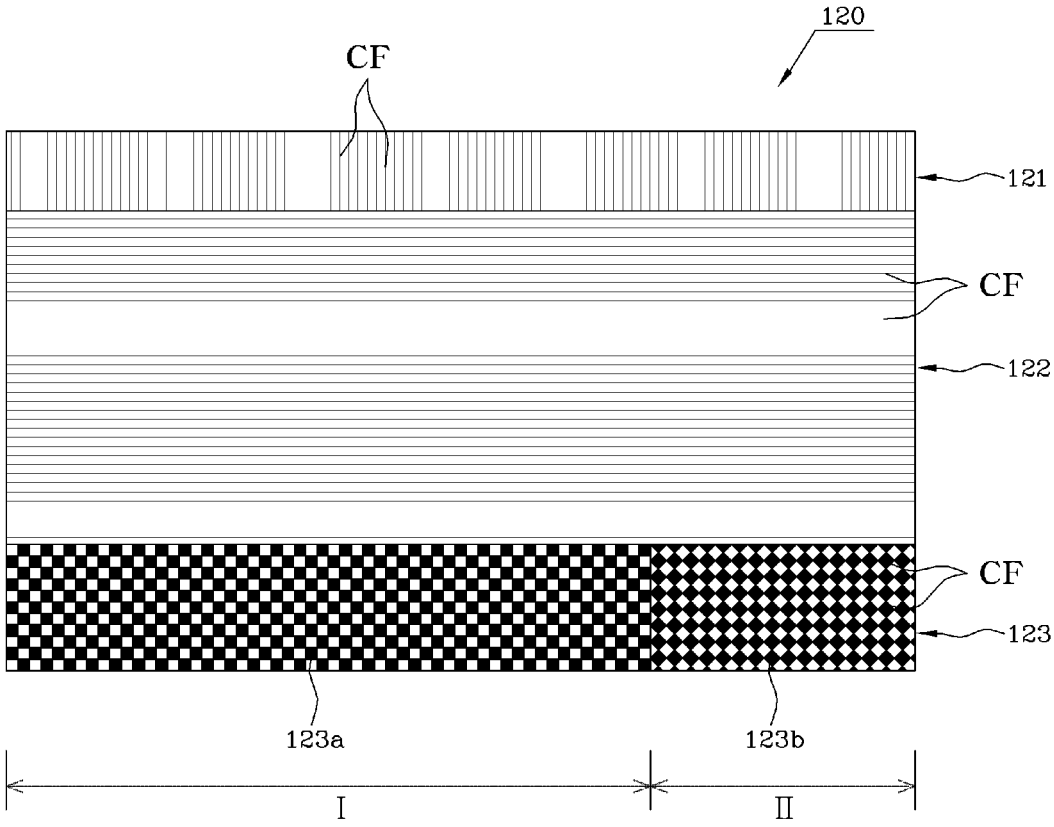
FIG. 5 is a developed view showing an arrow shaft shaping sheet according to a second embodiment of the present invention.
Figure 6:
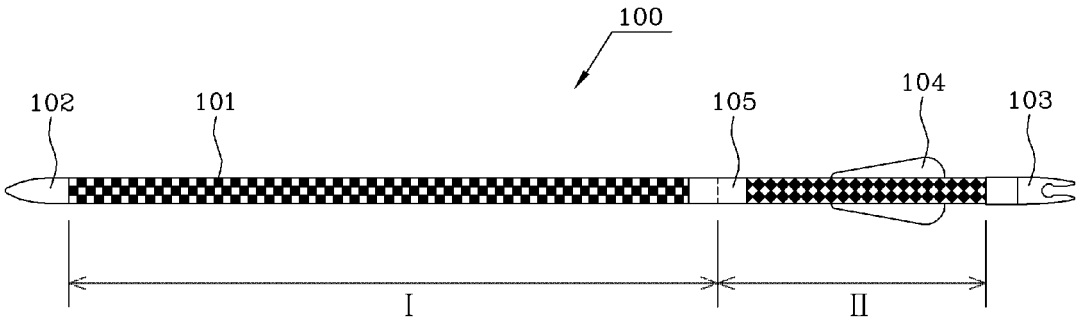
FIG. 6 is a schematic view showing an arrow shaft having a border cover film attached thereon according to the present invention.

FIG. 5 shows a developed view of an arrow shaft shaping sheet according to a second embodiment of the present invention. The configuration of a third sheet layer of the present embodiment differs compared to the first embodiment described above, and the remaining configurations are the same as those of the first embodiment. Namely, configurations of a first sheet layer 121 and a second sheet layer 122 of the present embodiment are the same as those of the first embodiment. However, according to the present embodiment, the configuration of the rear sheet 123*b* is different from that of the first embodiment. The rear sheet 123*b* is still formed of a carbon fabric sheet woven by intersecting carbon fibers each other similar to the first embodiment, but in this case, the direction of arrangement of the woven carbon fibers is different from that of a carbon fabric sheet of the front sheet 123*a*. Specifically, according to the embodiment, the front sheet 123*a* and the rear sheet 123*b* are both formed of carbon fabric sheets, but are provided by laminating the carbon fabric sheets such that arrangements of woven carbon fibers in both carbon fabric sheets are different from each other as shown. In FIG. 6, carbon fibers of the carbon fabric sheet for the front sheet 123*a* are arranged to intersect horizontally and vertically, but for the rear sheet 123*b*, carbon fibers are arranged to intersect diagonally. The reason is because, for the carbon fabric sheets, the strengths thereof vary depending on an inclination angle weaving carbon fibers or the distance between woven carbon fibers.

FIG. 6 shows a schematic view of an arrow shaft having a border cover film attached thereon according to the present invention. A border portion between the front part I and the rear part II which are the outermost layer of the arrow shaft 101 manufactured by the method described above has a border cover film 105 formed thereon as shown. Namely, a layer of the border cover film 105 such as a synthetic resin tape may be further provided on the border portion between the front sheet 113*a* and 123*a* and the rear part 113*b* and 123*b* of the third sheet layer 113 and 123 as the outermost layer.

The border cover film 105 can be coated with a resin material or paint, or can be formed by wrapping with a thin resin film. Alternatively, the border cover film 105 may be provided by attaching a transfer paper having a model name, a logo and the like printed thereon.

As set forth above, the arrow shaft according to the present invention is configured to have different spine strengths between the front part including the center of gravity which can be considered the waist portion of the arrow shaft and the rear part to which the nock is coupled. As a result, adverse effects in terms of the influence that the materials have on the arrow shaft can be improved and the weight balance between the front part and the rear part of the arrow shaft can be maintained such that the flight stability can be achieved. In particular, the arrow shaft will be advantageous when being applied to archery arrows which are shot very many times and thus likely to be damaged or deformed due to frequent exposure to repeated fatigue loads.

Although an exemplary embodiment of the invention has been described for illustrative purposes, those skilled in the art will appreciate that various modifications, additions and substitutions are possible, without departing from the scope and spirit of the invention as disclosed in the accompanying claims.

What is claimed is:

1. An arrow shaft having a front and rear two stage spine structure and including a front end to which an arrowhead is coupled and a rear end to which a nock is coupled, wherein the arrow shaft has a hollow tubular shape and is divided and defined into a front part and a rear part along a longitudinal direction thereof such that spine strengths of the arrow shaft are different between the front part including a center of gravity of the arrow shaft and the rear part to which the nock is coupled;

wherein the arrow shaft is formed by winding an arrow shaft shaping sheet, the arrow shaft shaping sheet comprising:

a first single sheet layer having a plurality of carbon fibers arranged in parallel in one direction and configured to cover both of the front and rear parts;

a second single sheet layer attached and connected to a lower end of the first single sheet layer, the second single sheet layer having a plurality of carbon fibers arranged in parallel in another direction and configured to cover both of the front and rear parts; and a third sheet layer attached and connected to a lower end of the second single sheet layer, the third sheet layer including a front sheet formed of a carbon fabric sheet to cover the front part and a rear sheet formed of another carbon fabric sheet having higher elastic strength than that of the front sheet to cover the rear part, wherein the front sheet is connected to the rear sheet.

2. The arrow shaft according to claim 1, wherein the front sheet and the rear sheet of the third sheet layer are respectively formed of carbon fabric sheets each having woven carbon fibers which are arranged in different directions.

3. The arrow shaft according to claim 2, wherein a length ratio of the front part to the rear part is in a range of 6:4~7:3 based on a total length of the arrow shaft.

4. The arrow shaft according to claim 2, wherein a border cover film is provided on a border portion between the front sheet and the rear sheet.

5. The arrow shaft according to claim 1, wherein a length ratio of the front part to the rear part is in a range of 6:4~7:3 based on a total length of the arrow shaft.

6. The arrow shaft according to claim 1, wherein a border cover film is provided on a border portion between the front sheet and the rear sheet.

* * * * *